US005781825A

United States Patent [19]

Okamoto

[11] Patent Number: 5,781,825

[45] Date of Patent: Jul. 14, 1998

[54] IMAGE FORMING DEVICE WITH FEEDING MECHANISM FOR FEEDING A PLURALITY OF DOCUMENTS

[75] Inventor: Yuji Okamoto, Nara, Japan

[73] Assignee: Sharp Kabushiki Kaisha, Osaka, Japan

[21] Appl. No.: 713,756

[22] Filed: Sep. 13, 1996

[30] Foreign Application Priority Data

Sep. 13, 1995 [JP] Japan ..... 7-235313

[51] Int. Cl.[6] ..... G03G 15/00

[52] U.S. Cl. ..... 399/17; 399/373

[58] Field of Search ..... 399/16–19, 21, 399/79, 87, 373, 374; 271/3.05, 3.06, 3.08, 3.09, 176, 199, 256

[56] References Cited

U.S. PATENT DOCUMENTS

| | | | |
|---|---|---|---|
| 4,621,921 | 11/1986 | Takahata et al. | 399/19 |
| 5,034,770 | 7/1991 | O'Connell | 399/79 |
| 5,088,714 | 2/1992 | Nagasawa et al. | 271/3.08 |
| 5,099,291 | 3/1992 | Yoshioka et al. | 399/17 |

FOREIGN PATENT DOCUMENTS 63-247767 10/1988 Japan .

*Primary Examiner*—William J. Royer

[57] ABSTRACT

An image-forming apparatus equipped with a recirculative document handler, designed in such a manner that when a sensor S2 provided along the document conveyer path is turned on to indicate completion of feeding of a single document, the on/off state of a one-circulation detecting sensor S1, which detects the state of circulating documents, is read in the document-holding section, and the result of addition of "1" to the count of a counter Y which counts fed documents is stored as the maximum document page number when a not-yet-fed document is present in the document-holding section, and thus the one-circulation detecting sensor S1 has not detected one circulation of all the documents, whereas the count of the counter Y is stored as the total document page number when the one-circulation detecting sensor S1 is in the ON state. An additional sheet is fed only when the maximum document page number exceeds the number of fed sheets which have been counted by a counter X.

8 Claims, 14 Drawing Sheets

IMAGE FORMING DEVICE WITH FEEDING MECHANISM FOR FEEDING A PLURALITY OF DOCUMENTS

BACKGROUND OF THE INVENTION

1. Field of the Invention

The present invention relates to an image-forming apparatus equipped with a sheet-feeding mechanism, such as a copying machine or printer, and more particularly to an image-forming apparatus equipped with a recirculative document handler which feeds a plurality of documents in a circulating manner.

2. Description of the Related Art

Some types of image-forming apparatuses are equipped with recirculative document handlers which facilitate handling of a plurality of documents when images thereof are being taken successively. The recirculative document handlers are designed to convey a plurality of documents stacked at a document-stacking station from the document-stacking position to an exposure station, and to return the documents from the exposure station to the document-stacking station, one by one without changing the stacking order. On the other hand, the image-forming apparatuses are designed to convey a plurality of sheets held at a sheet-holding station to a reference position for image-formation sheet by sheet, and to convey the sheets from the reference position for image-formation to image-forming sections, in synchronization with timing for image-formation.

With image-forming apparatuses equipped with such recirculative document handlers, the sheet-conveying time is longer than the document-conveying time in cases where the document-conveying distance from the document-stacking station to the exposure station in the recirculative document handler is shorter than the sheet-conveying distance from the sheet-holding station to the reference position for image-formation in the image-forming apparatus. Therefore, in order to speed up the operation for the image-formation of a plurality of documents, it is necessary to initiate feeding of sheets prior to timing for feeding the associated documents, with care not to feed more sheets than documents in order to avoid waste of sheets.

To fill this need, a conventional image-forming apparatus equipped with a recirculative document handler is designed so that the number of sheets to be fed is compared with the precounted number of pages of the documents, and sheets are fed until the number of fed sheets reaches the number of pages of the documents. In addition, according to the configuration disclosed in Japanese Unexamined Patent Application Disclosure HEI 1-232363, it is designed so that the next sheet is not fed until formation of an image on the preceding sheet is achieved during the first circulation of the documents, while counting the number pages of the documents, whereas the next sheet is fed before formation of an image on the preceding sheet has been completed until the number of the fed sheets reaches the number of pages of the documents during the second circulation of the documents and onward.

Conventional image-forming apparatuses equipped with recirculative document handlers, however, have the problem of prolonged image-forming time, since a preliminary circulating operation must be conducted just to count the document pages, and the time interval between sheet feedings must be extended during the first circulation of the documents.

SUMMARY OF THE INVENTION

It is an object of the present invention to provide an image-forming apparatus equipped with a recirculative document handler, which allows conveying of a subsequent sheet prior to completion of formation of an image on the preceding sheet, without counting the document pages in advance, and results in a shorter image-forming operation.

It is another object of the invention to provide an image-forming apparatus equipped with a recirculative document handler, which facilitates post-treatment such as a gathering operation.

In a first aspect of the invention, the image-forming apparatus is characterized by comprising a document-feed counter which is incremented each time a document is fed; a sheet-feed counter which is incremented each time a sheet is fed; and maximum document-page-number storage means which determines whether all the documents have been fed each time a document has been fed, and stores the result as an addition of "1" to the count of the document-feed counter in cases where all the documents have not yet been fed, wherein it is also determined whether the corresponding document is present or not each time a sheet is fed, and a sheet is fed only when the corresponding document is present by allowing feeding of a subsequent sheet only when the count of the sheet-feed counter is smaller than the value stored in the maximum document-page-number storage means.

In a second aspect of the invention, the image-forming apparatus is characterized by comprising sheet-information storage means for storing information about individual sheets to be fed, and by comprising total document-page-number storage means which determines whether all the documents have been fed each time a document has been fed, and stores the count of the document-feed counter as the total document page number when all the documents have been fed, wherein when the count of the sheet-feed counter matches the value stored in the total document-page-number storage means, information about the final sheet is added to the sheet-information about the preceding fed sheets to create information which serves to identify the sheet on which an image of the last document of the stacked documents has been formed.

In a third aspect of the invention, the image-forming apparatus is characterized by correcting the value stored in the maximum document-page-number storage means depending on the set image-forming mode.

The image-forming apparatus is characterized by correcting the value (Z) stored in the maximum document-page-number storage means according to the equation: $Z'=Z/2$ to store a new value (Z') when the image-forming mode is set for copying images of single-sided documents on double-sided sheets (hereunder referred to as simplex/duplex copying or S/D copying).

The image-forming apparatus is further characterized by correcting the value (Z) stored in the maximum document-page-number storage means according to the equation: $Z'=2Z$ to store a new value (Z') when the image-forming mode is set for copying images of double-sided documents on single-sided sheets (hereunder referred to as duplex/simplex copying or D/S copying).

According to the first aspect of the invention, the determination whether the corresponding document is present when a sheet is fed allows minimization of the sheet-feeding interval, and a precise and speedy image-forming operation with greatly increased operation efficiency.

According to the second aspect of the invention, it is possible to determine whether the fed sheet is for the final document, immediately after feeding of the sheet, and thus to precisely execute the post-treatment based on the information that the fed sheet is for the final document, in cases where the fed sheet is for the final document.

According to the third aspect of the invention, correction of the stored maximum document-page-count, which is used to determine whether the corresponding document is present for a sheet to be fed next, depending on the preset image-forming mode allows proper determination on whether a document which corresponds to the sheet to be fed is present or not, regardless of the set image-forming mode, thus increasing the efficiency of the operation.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
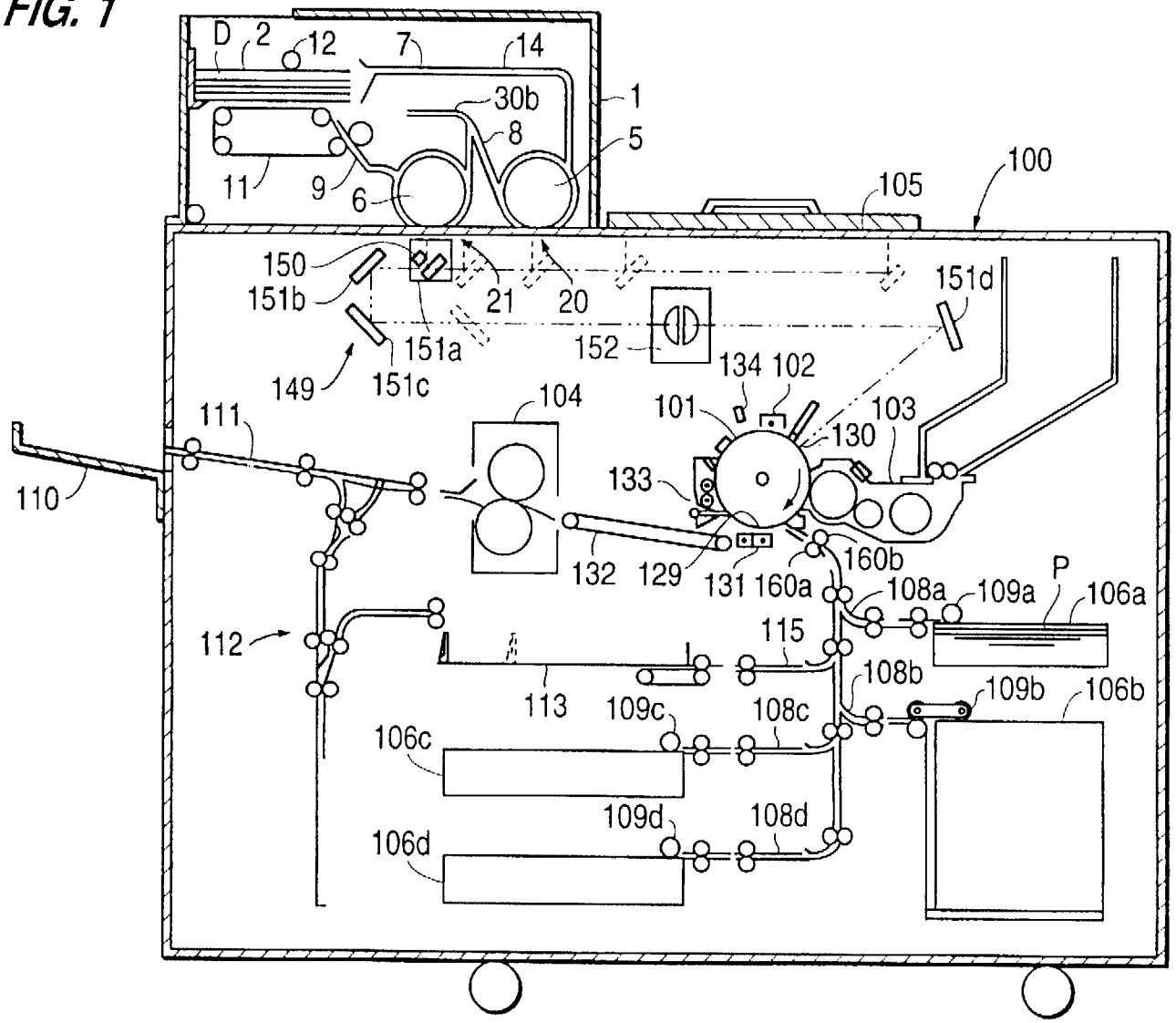
FIG. 1 is a schematic, sectional front view illustrative of the configuration of a copying machine as an embodiment of the recirculative document handler-equipped, image-forming apparatus according to the present invention.

Now referring to the drawings, preferred embodiments of the invention are described below.

FIG. 1 is a schematic, sectional front view illustrative of the basic configuration of an electrophotographic copying machine loaded with a recirculative document handler (hereunder sometimes abbreviated to "RDH"). A cylindrical photoconductor 101 is held in the center in the inside of a body 100 of the copying machine in a freely rotatable manner. Provided along the outer circumference of the photoconductor 101 are a corona discharger 102, a developing device 103, etc. which constitute a copying process section. The upper inside of the body 100 of the copying machine is provided with exposing means 149 which comprises a light source 150 for slit exposure of document surfaces, mirrors 151*a*–151*d* and a lens 152. With the exposing means 149, beams of light from the light source 150 are reflected from the document and are focused in an exposure region 130 on the photoconductor 101 via the mirrors 151*a*–151*d* and the lens 152. The exposing means 149 stops at a first reading station 20 or a second reading station 21 to expose and read the image on the document. Also, at a third reading station 105, the document such as a book is exposed to read by scanning with a first mobile unit equipped with the light source 150 and the mirror 151*a*.

Sheet feeder cassettes 106*a*–106*d* are mounted at a lower place inside the body 100 of the copying machine. Sheet feeder paths 108*a*–108*d* leading to the photoconductor 101 are provided for the sheet feeder cassettes 106*a*–106*d*, respectively. Sheets of paper P held in the sheet feeder cassettes 106*a*–106*d* are successively fed by rotation of the sheet feeder rollers 109*a*–109*d*, in order starting with the uppermost sheet.

A sheet conveyer belt 132 is provided extending from the image-forming process section which holds the photoconductor 101 to a fixing device 104. A conveyer path 111 is formed extending from the fixing device 104 to an ejected-sheet tray 110. In addition, a switchback conveyer path 112 to an intermediate tray 113 branches from the conveyer path 111. A sheet feeder path 115 is formed extending from the intermediate tray 113 to the image-forming process section. Timing for the conveyance of paper P fed by the sheet feeder cassettes 106*a*–106*d* or the intermediate tray 113 to the photoconductor 101 is controlled by third registration rollers 160*a* and 160*b* which are placed midway along the conveyer path to the photoconductor 101. More specifically, the conveyance of paper P is paused upon contact of the front end of paper P being conveyed to the photoconductor 101 with the third registration rollers 160*a* and 160*b*, and is then guided to a transfer station 129 located between the photoconductor 101 and a transfer device 131 by rotation of the registration rollers 160*a* and 160*b*, in synchronization with rotation of the photoconductor 101.

In the copying process section, the surface of the photoconductor 101, after having been charged to a monopolarity by the corona discharger 102, is exposed to light reflected from the document at an exposure station 130 to form an electrostatic latent image. The electrostatic latent image is rendered visible by a developing agent which is supplied from the developing device 103 and transferred onto paper P by the transfer device 131 in the transfer station 129. The surface of the photoconductor 101 is then subjected to removal of the residual toner by a cleaner 133 and to removal of the residual charge by a destaticizing device 134. Meanwhile, image-transferred paper P is guided to the fixing device 104 by the conveyer belt 132 to receive heat and pressure to thereby fuse and fix the toner image, and is then ejected to the ejected-sheet tray 110 via the conveyer path 111.

A RDH 1 placed on the top surface of the body 100 of the copying machine serves to convey document D stacked in a document-holding section 2 through a passage in a circulating manner starting and ending with the document-holding section 2 via a conveyer path 14, a first document drum 5, document-reversing means 8, a second document drum 6 and document-holding means 9. The first document drum 5 is positioned facing the first reading station 20 of the exposure device 149, while the second document drum 6 is positioned facing the second reading station 21. Element 30*b* represents part of a reverse path.

Figure 2:
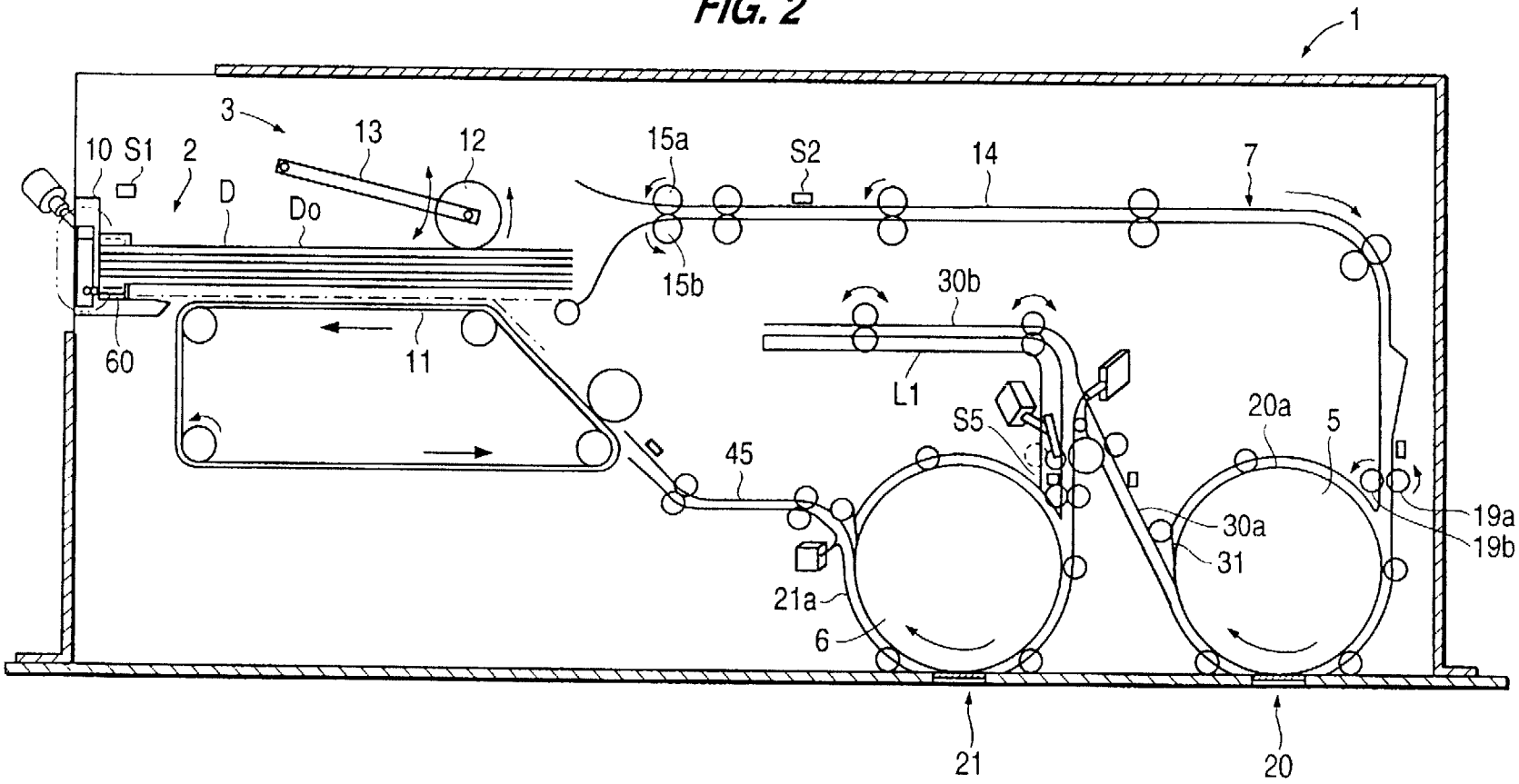
FIG. 2 is a sectional front view illustrative of the configuration of the recirculative document handler shown in FIG. 1.

FIG. 2 is a sectional front view illustrative of details of the configuration of the RDH 1 described above. Document D, usually a plurality of document sheets, is held in the document-holding section 2 of the RDH 1, with the edges evened up by an edge-evening member 10. The documents held in the document-holding section 2 are successively fed to document-conveying means 7 by document-feeding means 3 sheet by sheet, in order starting with the uppermost one. The document-feeding means 3 is constructed of a lever 13 held in a freely rocking manner, and a feeding roller 12 is born at one end of the lever 13. The document-conveying means 7 is provided with the conveyer path 14 which extends horizontally and bends vertically downward, and handling rollers 15*a* and 15*b*, which prevent concurrent conveyance of two or more documents D are provided at the entrance end of the conveyer path 14. The handling rollers 15*a* and 15*b* rotate in directions opposite to each other to guide only the uppermost document into the conveyer path 14 when a plurality of documents D are fed by the feeding roller 12.

A pair of first registration rollers 19*a* and 19*b* are provided at the exit section of the conveyer path 14. The first registration rollers 19*a* and 19*b* are controlled so as to be either mere conveyer rollers or rollers for controlling timing for the conveyance of document D to the first document drum 5, depending on the preset copying process. A surrounding conveyer path 20*a* composed of a plurality of rollers is constructed along the outside circumference of the first document drum 5; the surrounding conveyer path 20*a* is coupled to another surrounding conveyer path 21*a* formed along the outside circumference of the second document drum 6 via reverse paths 30*a*–30*b*. In addition, the surrounding conveyer path 21*a* is connected to the document-holding section 2 provided with a conveyer belt 11, via a holding path 45.

The document-holding section 2 is provided with a one-circulation detecting sensor S1. The one-circulation detecting sensor S1 detects whether all the documents stacked in the document-holding section 2 have been circulated once, depending on the presence or absence of a contact member 60. More specifically, the contact member 60, which is located at the lowermost position in the document-holding section 2 when no documents are stacked in the document-holding section 2, comes into contact with the lowermost document when documents are stacked. The contact member 60 gradually moves upward as the documents are successively fed starting with the uppermost one and return to the bottom of the document-holding section 2 via the outside of the document-holding section 2 by rotation of a motor (not shown) when the contact member 60 has reached the uppermost position in the document-holding section 2 as a result of one-circulation feeding of all the documents. Accordingly, the one-circulation detecting sensor S1 is turned on upon detection of light which is projected downward and reflected from the contact member 60, to detect one circulation of the documents.

An explanation will now be given regarding an operation of copying Images on documents with the body 100 of the copying machine which is equipped with the recirculative document handler 1 constructed as described above. First, when images on single-sided documents are copied on single-sided sheets (hereunder referred to as simplex/simplex copying or S/S copying), the documents held in the document-holding section 2, with the image sides turned up, are guided to the first document drum 5 via the conveyer path 14. In the body 100 of the copying machine, paper P is fed from any of the feeder cassettes 106*a*–106*d* in synchronization with conveyance of the documents, with the light source 150 and the mirror 151*a* located at the first reading station 20. When an image on a single-sided document is multi-copied on a plurality of sheets, a flapper 31 is moved to the position indicated by the broken line in the drawing, and the document is wound around the first document drum 5, and the image side of the document passes through the first reading station 20 a predetermined number of times.

When a copying process for a predetermined number of sheets of paper P has been finished in the body 100 of the copying machine, the flapper 31 is moved to the position indicated by the solid line in FIG. 2 to convey document D to the reverse paths 30*a*–30*b*. The reverse paths 30*a*–30*b* subject document D to a switchback operation by which the direction of conveyance is reversed, to turn document D upside down and to guide document D to the surrounding conveyer path 21*a*. Document D moves, without being subjected to image reading, via the second reading station 21, part of the surrounding conveyer path 21*a* and the holding path 45 by rotation of the second document drum 6, and is then conveyed to the lowermost portion of the document-holding section 2 by the conveyer belt 11 to be held therein. On the other hand, the copied sheets are ejected to the ejected-sheet tray 110 via the ejected-sheet conveyer path 111.

When images on two single-sided documents are copied on both sides of a single sheet, the sheet which has undergone the process of copying the image of a first document on a first side thereof is guided to the intermediate tray 113 via the reverse conveyer path 112. The sheet is fed from the intermediate tray 113 in synchronization with conveyance of a second document to carry out a copying process on a second side of the sheet. The sheet with the document images copied on both sides is ejected to the ejected-sheet tray 110 via the ejected-sheet conveyer path 111.

Multi-copying of images of two documents on both sides of a predetermined number of sheets may be carried out according to two methods: a first method comprises repeating a set of two copying processes a predetermined number of times, wherein the image of a first document is copied on a first side of a sheet according to a first process and the image of a second document is copied on a second side of the same sheet according to a second process, and a second method comprises copying the image of a first document on first sides of a predetermined number of sheets which are then held in the intermediate tray 113, followed by copying of the image of a second document on second sides of the single side-copied sheets which are fed from the intermediate tray 113.

When images of a double-sided document are copied, after a copying process has been finished for the image of a first side (front side) of the document which passes through part of the surrounding path 20*a*, with the light source 150 and the mirror 151*a* located at the first reading station 20, the light 150 and the mirror 151*a* are moved to the second reading station 21 while the document is being conveyed through the reverse paths 30*a*–30*b*, to execute a copying process for a second side (back side) of the document which passes through the surrounding path 21*a*. Here, the images of both sides of the double-sided document are each copied on single sides of two sheets by feeding the sheets from any of the sheet feeder cassettes 106*a*–106*d* each time first and second sides of the document are subjected to copying processes. In addition, images of both sides of a double-sided document are copied on both sides of a single sheet by holding the sheet fed for the process of copying the image of a first side of the document and conveyed via the reverse conveyer path 112 in the intermediate tray 113, and feeding the single-sided copied sheet from the intermediate tray 113 for the process of copying the image of a second side of the document. Multi-copying of double-sided documents may also be carried out by two methods, that is, a method which involves predetermined time-circulation of the documents, and a method in which the documents are passed through the surrounding paths 20*a* and 21*a* a predetermined number of times while wound around the document drums 5 and 6.

Figure 3:
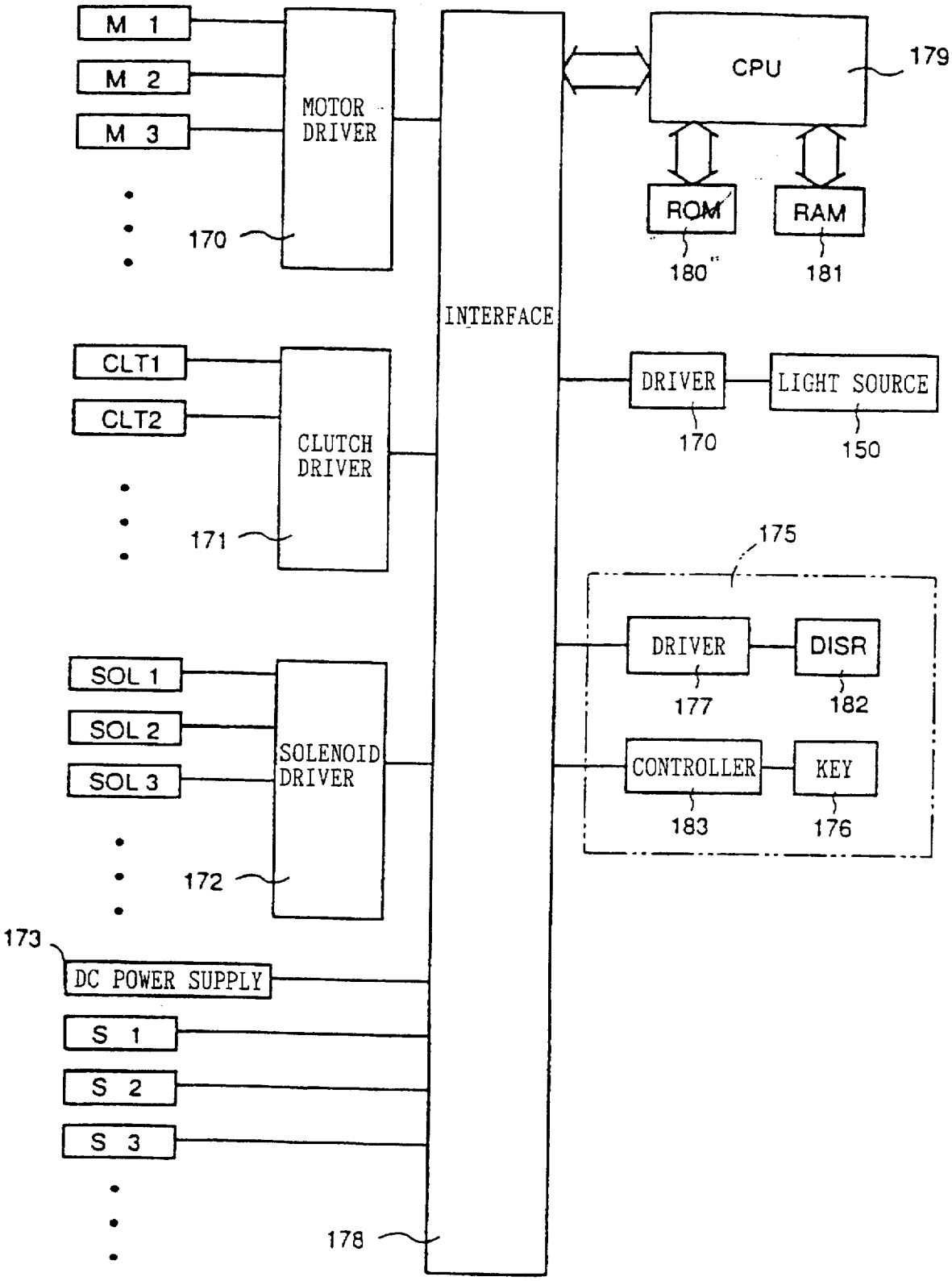
FIG. 3 is a block diagram illustrative of the configuration of the control section of the copying machine shown in FIG. 1.

FIG. 3 is a block diagram illustrative of the configuration of the control section of the copying machine described above. The control section, which controls the recirculative document handler 1 and the body 100 of the copying machine, are constructed of a CPU 179 equipped with a ROM 180 and a RAM 181. Connected to the CPU 179 via an interface 178 are a motor driver 170, a clutch driver 171, a solenoid driver 172, a plurality of sensors S1–Sn, driver 177, and a controller 183. The CPU 179 receives a supply of current from a DC power supply 173, and controls these I/O devices according to a program written in the ROM 180 in advance. Data inputted or outputted during the process of copying is temporarily stored in a predetermined memory area in the RAM 181.

The CPU 179 reads operation with keys 176 in a control panel 175 and outputs data for driving the respective drive 170–172, and 177 depending on the state set by operation with the keys 176. A motor for driving the photoconductor 101 and motors which drive the document drums 5 and 6 are connected to the motor driver 170 together with motors which supply rotational forces to the rollers constituting the various conveyer paths. Connected to the clutch driver 171 is a clutch which selectively transfers rotation of the respective motors to the registration. rollers 19*a* and 19*b*, etc. Connected to the solenoid driver 172 is a solenoid which activates the flappers provided along the respective conveyer paths. A light source 150 is connected to a driver. A display (DISR) 182 provided in the control panel 175 is connected to the driver 177.

Figure 4:
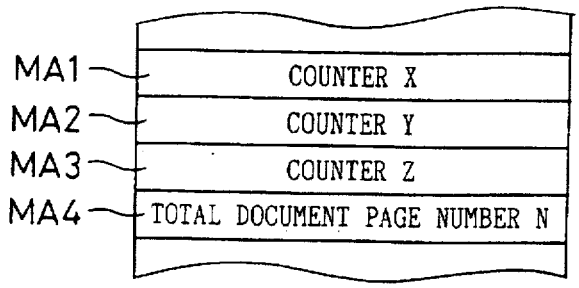
FIG. 4 is a memory map of the main portion inside the RAM in the control section shown in FIG. 3.

Here, as illustrated in FIG. 4, memory areas MA1–MA3 in the RAM 181 are allocated for counters X-Z, while a memory area MA4 is allocated as an area for storing the total document page number N. The counter X counts the number of fed sheets. The counter Y counts the number of fed documents. The counter Z counts the maximum document page number which is calculated by addition of "1" to the count of the counter Y when a document not yet fed is still present in the document-holding section 2 after a preceding document has been fed.

Figure 5A:
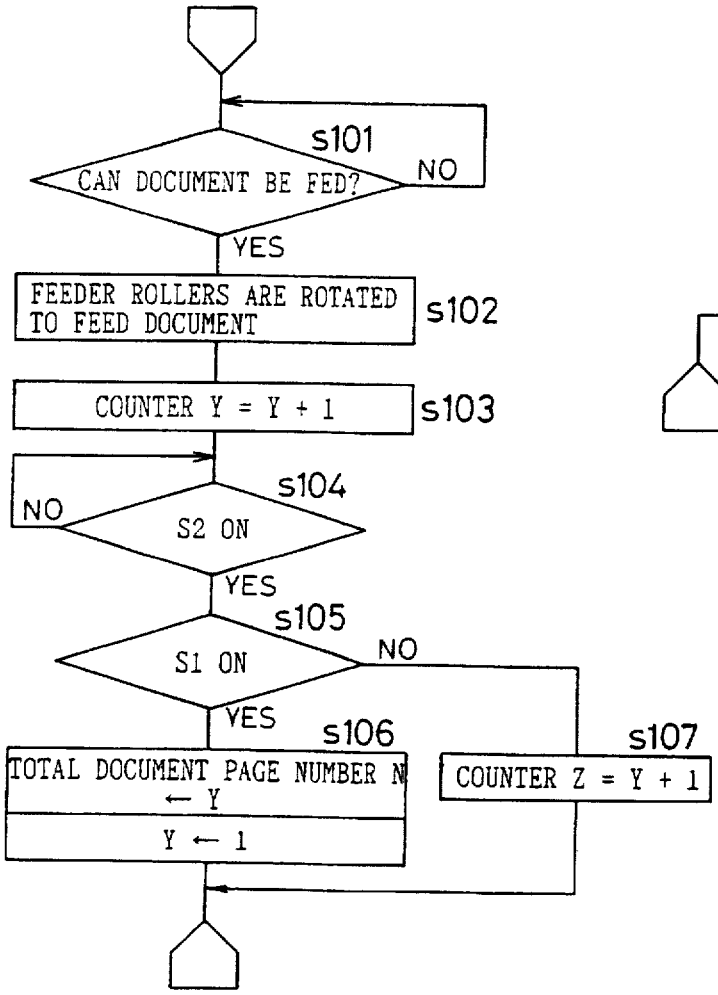
FIGS. 5A and 5B are flow charts illustrative of part of an operating procedure of a copying machine according to an embodiment of the invention.
Figure 5B:
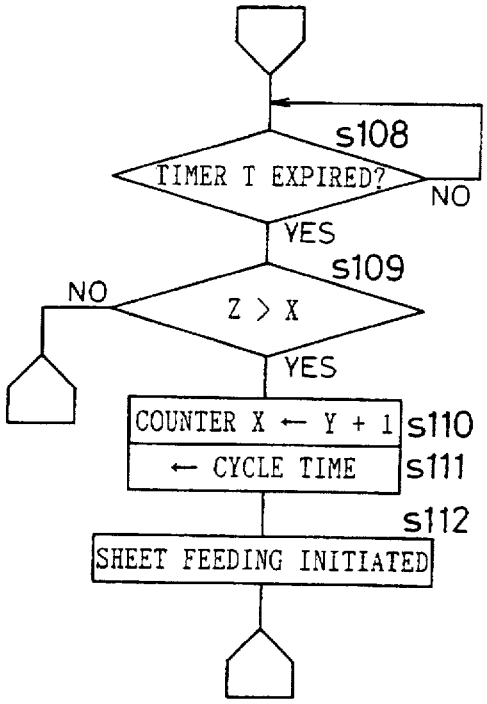

FIGS. 5A and 5B are flow charts illustrative of part of an operating procedure of a control section according to an embodiment of the invention. The CPU functions in such a manner that, for example, when the sensor S2 provided at the entrance of the conveyor path 14 cannot detect the preceding document, and a subsequent document can be fed (S101), the sheet feeder roller 12 starts to rotate to feed a document (S102). Concurrently, the count of the counter Y, for which the memory area MA2 in the RAM 181 is allocated, is incremented (S103). The sensor S2 is then turned on (S104), and the state detected by the one-circulation detecting sensor S1 is checked (S105). When the one-circulation detecting sensor S1 is in the ON state, and feeding of all the documents stacked in the document-holding section 2 has been completed, the count of the counter Y is stored in the memory area MA4 as the total document page number N (S106). In cases where all the documents stacked in the document-holding section 2 have not been fed, and the one-circulation detecting sensor S1 is in the OFF state, the result of addition of "1" to the count of the counter Y is stored in the memory area MA3 as the count of the counter Z (S107).

On the other hand, the CPU 179 compares the count of the counter X with the count of the counter Z when a timer T activated at the start of feeding of the last sheet expires (S108, S109). The timer T keeps a cycle time which is a predetermined time interval between sheet feedings. When the count of the counter X which counts the fed sheets is smaller than the count of the counter Z, the count of the counter X is incremented, and concurrently the timer T is set for the cycle time (S110, S111), and feeding of the sheets is initiated (S112).

The foregoing processing allows the CPU 179 to determine whether a not-yet-fed document is left in the document-holding section 2 each time a document D is fed, so that when at least one document D to be fed is present in the document-holding section, a maximum document-page-number including the document is stored as the count of the counter Z, and the count of the counter Z is compared with the count of the counter X, that is, the maximum document page number is compared with the number of the sheets fed up to that time, to feed sheets in a number not exceeding the maximum document page number. As a result, in cases where the document conveyance distance which is the distance between the front-end of the documents, in the direction of conveyance, held in the document-holding section 2 and the registration rollers 19*a* and 19*b* is shorter than the distance between the front-end of the sheets, in the direction of conveyance, held in the sheet feeder cassettes 106*a* and 106*b*, feeding of sheets in a number exceeding the number of the document pages is reliably prevented even when the sheet-feeding interval is shortened, and thus the copying time is shortened.

Figure 6:
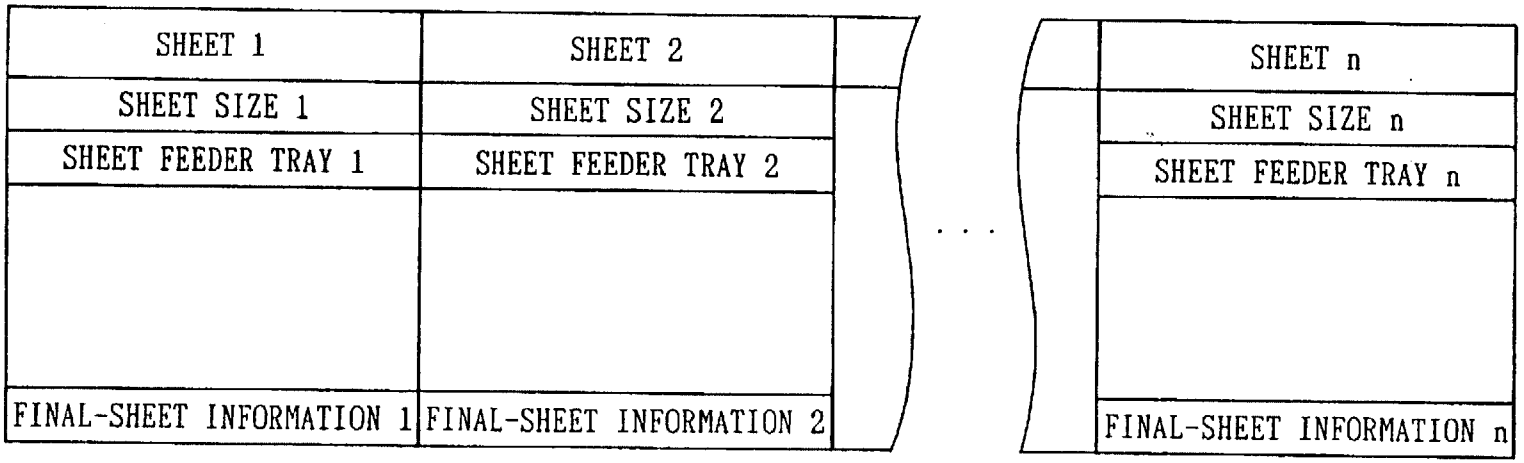
FIG. 6 is a view illustrative of part of memory contents of a RAM in the control section of a copying machine according to another embodiment of the invention.
Figure 7:
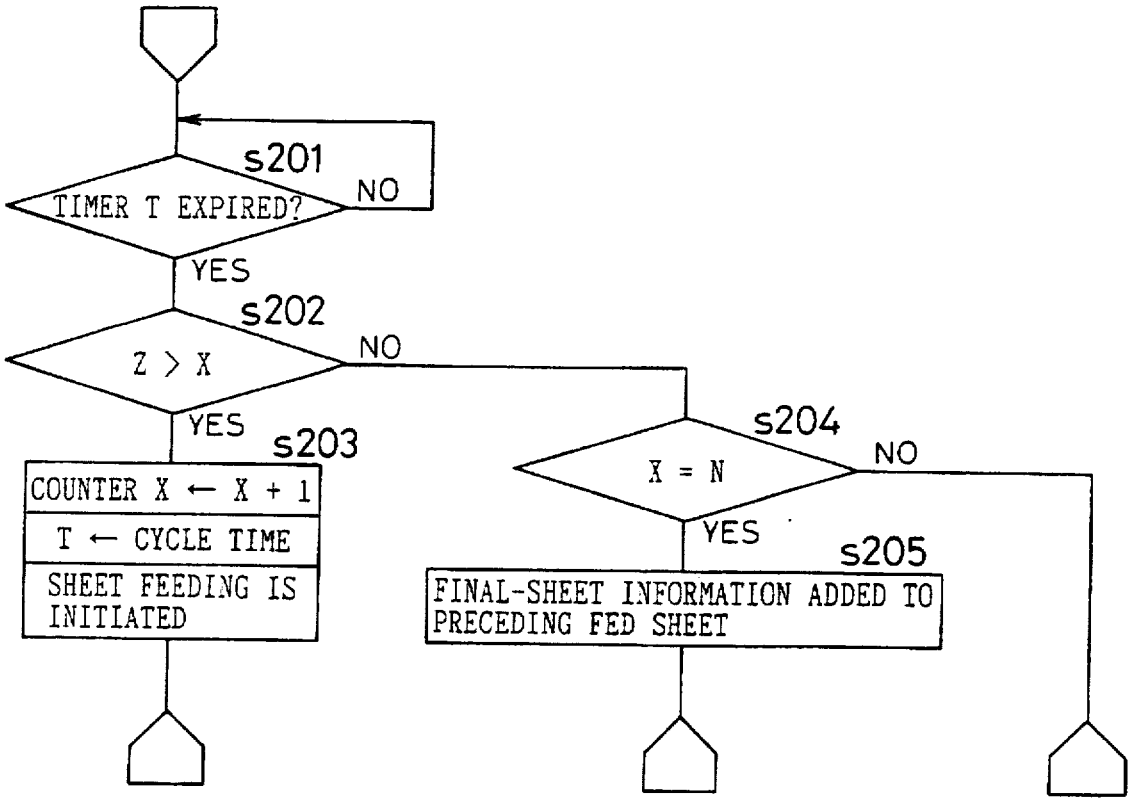
FIG. 7 is a flow chart illustrative of part of an operating procedure of a copying machine according to the other embodiment of the present invention.
Figure 8:
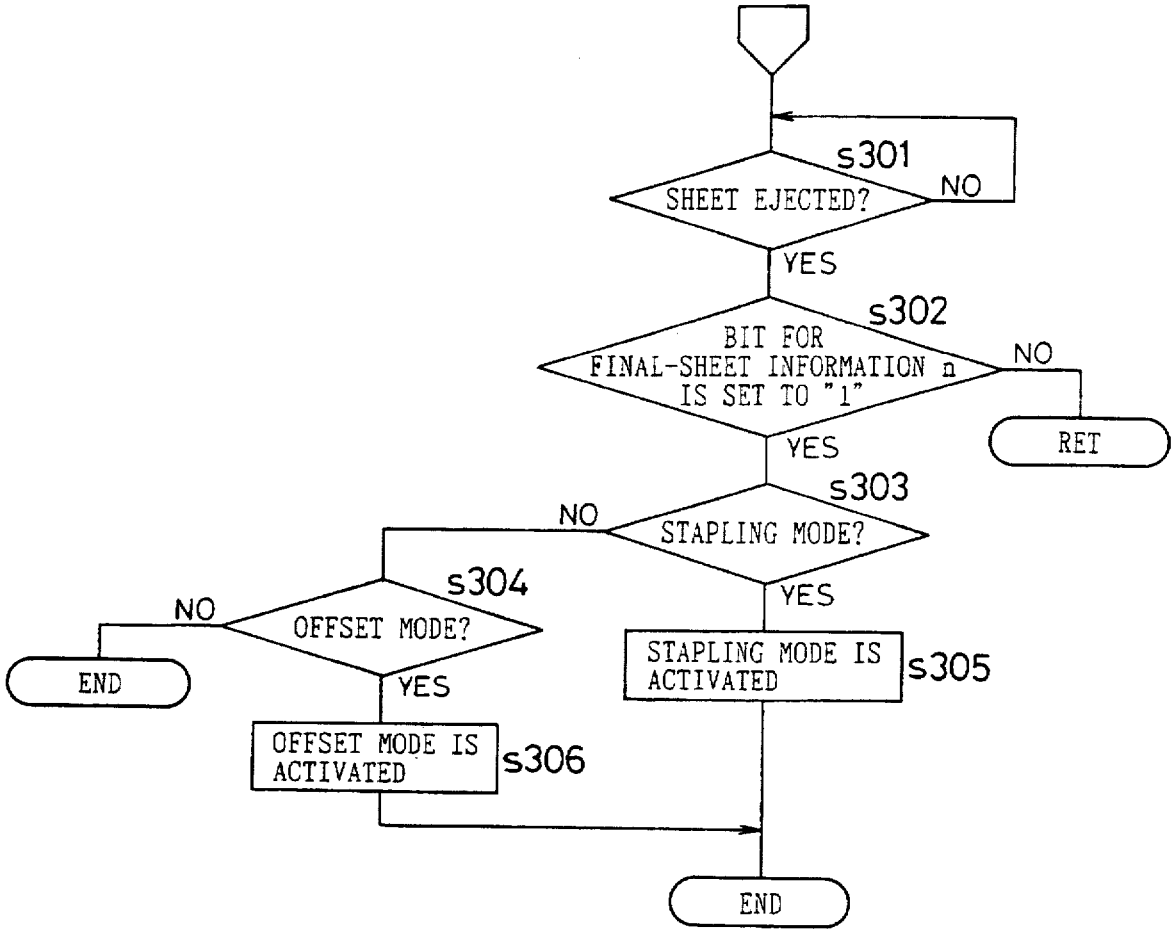
FIG. 8 is a flow chart which follows the flow chart shown in FIG. 7.

FIG. 6 through FIG. 8 are flow charts illustrative of the memory map of the main portion in the RAM and the operating procedure of the control section of a copying machine according to another embodiment of the invention. Part of the memory areas in the RAM 181 store data on sheets on a fed-sheet basis, including sizes of the fed sheets, specifications of sheet feeder trays and final-sheet information. The final-sheet information is data indicating that the fed sheet is the sheet with a copy of the image of the finally fed document. Preset post-processing such as stapling, offset processing or the like is carried out on the basis of the final-sheet information.

When the timer T expires (S201), the CPU 179 compares the count of the counter X with the count of the counter Z (S202), and in cases where the count of the counter X, which is the number of the sheets fed up to that time, is smaller than the count of the counter Z which indicates the maximum document page number, the count of the counter X is incremented, and concurrently the timer T is set for the cycle time, and feeding of sheets is initiated (S203). On the other hand, when the count of the counter X matches the count of the counter Z, the count of the counter X is compared with the value of the total document page number N (S204), and final-sheet information is added to sheet data for the preceding fed sheet (S205) when the number of the sheets fed up to that time is equal to the total document page number N. This results in setting to "1" contents of the bit for storing the final-sheet information in sheet data on the preceding fed sheet in the RAM 181.

FIG. 8 is a flow chart illustrative of an operating procedure for controlling a post-processing device which executes stapling or offset processing of the copied sheets which have been ejected from the body 100 of the copying machine. When a sheet is ejected to the ejected-sheet tray 110 (S301), the contents of the final-sheet information in sheet data for the sheet of interest in the RAM 181 are determined (S302). In cases where the contents of the bit which stores the final-sheet information regarding the ejected sheet are "1", it is determined whether a stapling mode or offset mode is preset (S303, S304), and operation according to the set mode is carried out (S305, S306).

The foregoing processing allows easy identification of the sheet on which the last document image has been copied, even when sheets are fed regardless of timing for feeding documents, and thus the copied sheets are exactly post-processed. The procedure illustrated in FIG. 8 may be carried out in the control section of the body 100 of the copying machine or the control section of the post-processing device. Here, the area in the RAM 181 which stores sheet data functions as the mail box for the control section of the post-processing device.

Figure 9:
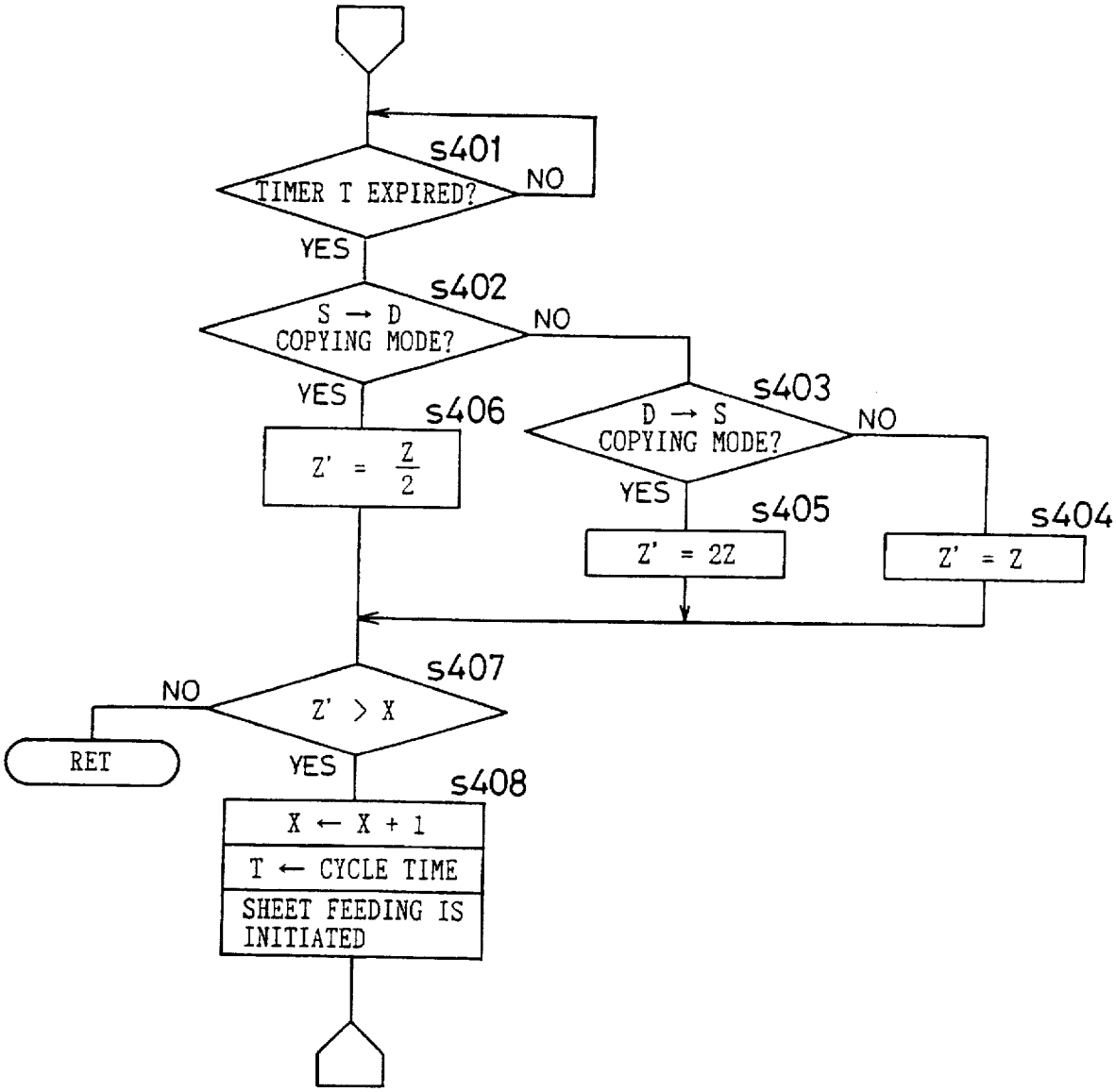
FIG. 9 is a flow chart illustrative of part of an operating procedure of a copying machine according to yet another embodiment of the present invention.

FIG. 9 is a flow chart illustrative of the process of correcting the count of the counter Z which counts a maximum document page number corresponding to the set copying mode. When the timer T expires which keeps a cycle time for feeding sheets (S401), the set copying mode is determined (S402, S403). A corrected maximum document page number Z' is determined by calculation according to the equation: Z'=Z/2 (S406) when the set copying mode is for simplex/duplex (S/D) copying, for example, when images of only even numbers of documents are copied on first sides of sheets during the first circulation of the documents, then the sheets are held in the intermediate tray 113, and then images of odd numbers of documents are copied on second sides of the single-side copied sheets which are fed from the intermediate tray 113 during the second circulation of the documents. In cases where the set copying mode is for duplex/simplex (D/S) copying, a corrected maximum document page number Z' is determined according to the equation: Z'=2Z (S405).

Z'=Z (S404) when the copying mode is set otherwise, that is, for simplex/simplex copying or duplex/duplex copying. The corrected maximum document page number Z' determined as described above is compared with the count of the counter X (S407). When the comparison reveals that the number of the sheets fed up to that time is smaller than the corrected maximum document page number Z', the count of the counter X is incremented, and concurrently the timer T is set for a sheet-feeding cycle and feeding of sheets is initiated (S408). The foregoing processing allows setting of the timing for feeding sheets, even when any copying mode is set, regardless of the timing for feeding documents, and the copying time may be shortened in any copying mode.

Figure 10:
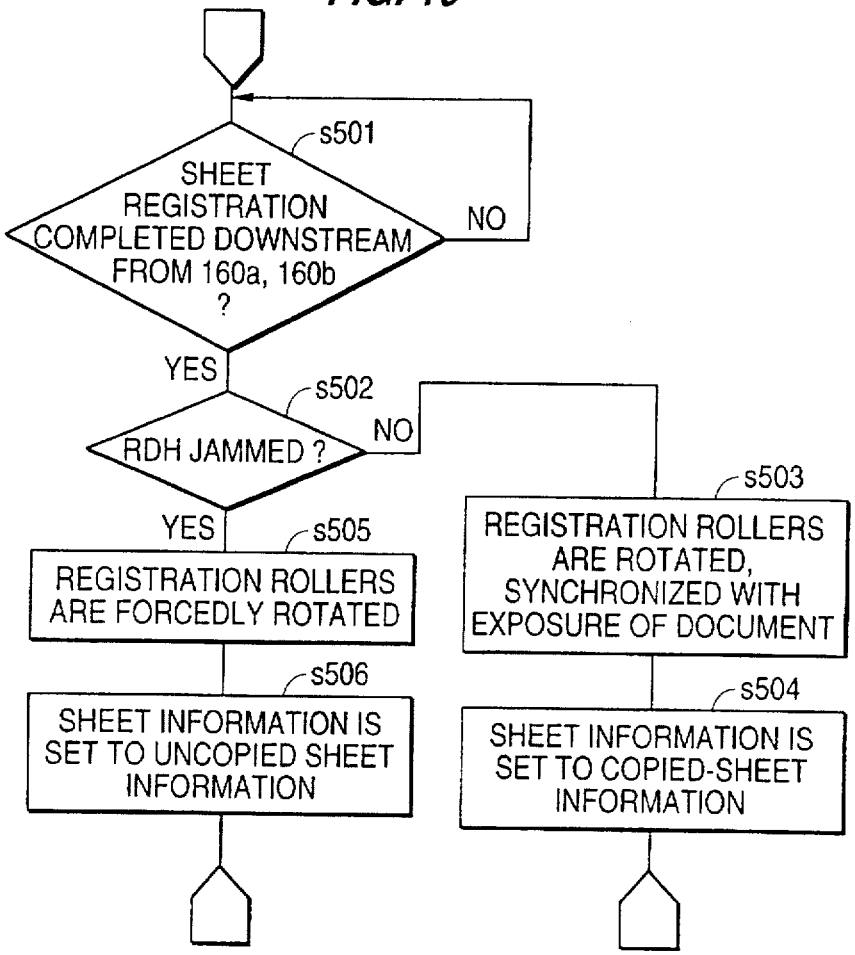
FIG. 10 is a flow chart illustrative of part of another operating procedure of the control section of a copying machine according to the invention.

FIG. 10 is a flow chart illustrative of an operating procedure of the control section of the body of the copying machine when a document has jammed the RDH. When a fed sheet has reached the registration rollers 160*a* and 160*b* (S501), the CPU 179 determines whether the document has jammed the RDH 1 (S502). In cases where the document has not jammed the RDH 1, the registration rollers 160*a* and 160*b* are rotated in synchronization with rotation of the photoconductor 101 (S503), and the bit representing copied-sheet information in the sheet data for the sheet of interest which is stored in the RAM 181 is set to "1" (S504). On the other hand, when the document has jammed the RDH 1, the registration rollers 160*a* and 160*b* are forcedly rotated regardless of rotation of the photoconductor 101 (S505), and the fed sheet is ejected without being copied. Concurrently, the bit representing uncopied-sheet information in the sheet data for the sheet of interest is set to "1" (S506).

Figure 11:
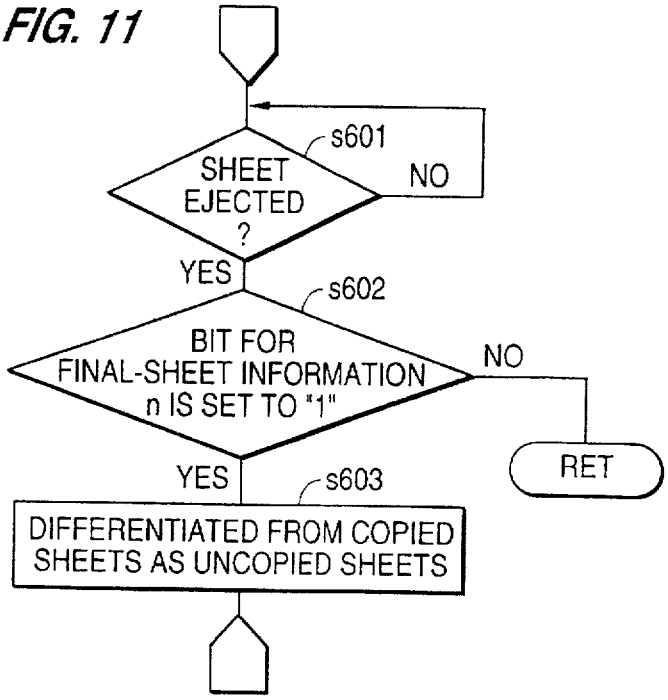
FIG. 11 is a flow chart which follows the flow chart shown in FIG. 10.

FIG. 11 is a flow chart illustrative of an operating procedure for controlling the post-processing section of the copying machine. When a sheet is ejected to the ejected-sheet tray 110 (S601), the CPU 179 determines whether the bit for the uncopied-sheet information which constitutes the sheet data for the sheet of interest in the RAM 181 is set to "1" (S602). When uncopied-sheet information is set in the sheet data for the ejected sheet, the uncopied sheet is held separately from the copied sheets by switching between ejected-sheet trays (S603).

The foregoing processing allows separation of sheets corresponding to jamming-caused documents from other copied sheets, without subjecting the former sheets to a copying process, thereby ensuring precise execution of the copying operation even when documents have jammed the RDH 1. Here, the storage area in the RAM 181 for sheet data may be functioned as the mail box so that the process illustrated in FIG. 11 is carried out in the control section of the post-processing device. Further, in cases where documents have jammed the RDH 1, and therefore uncopied sheets are produced, preset post-processing may be canceled.

Figure 12:
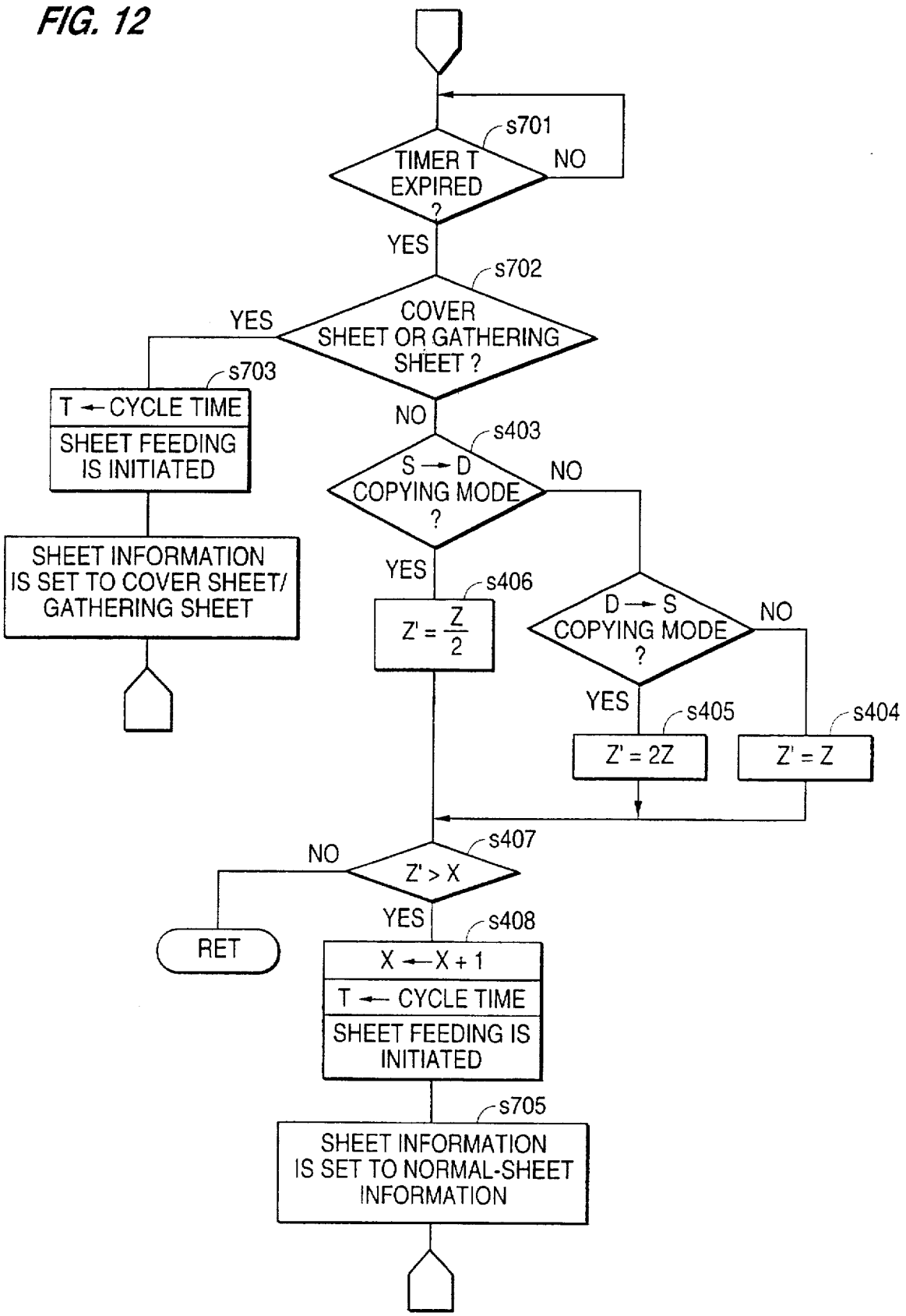
FIG. 12 is a flow chart illustrative of part of an operating procedure of the control section of a copying machine when a blank cover sheet is stacked.
Figure 13:
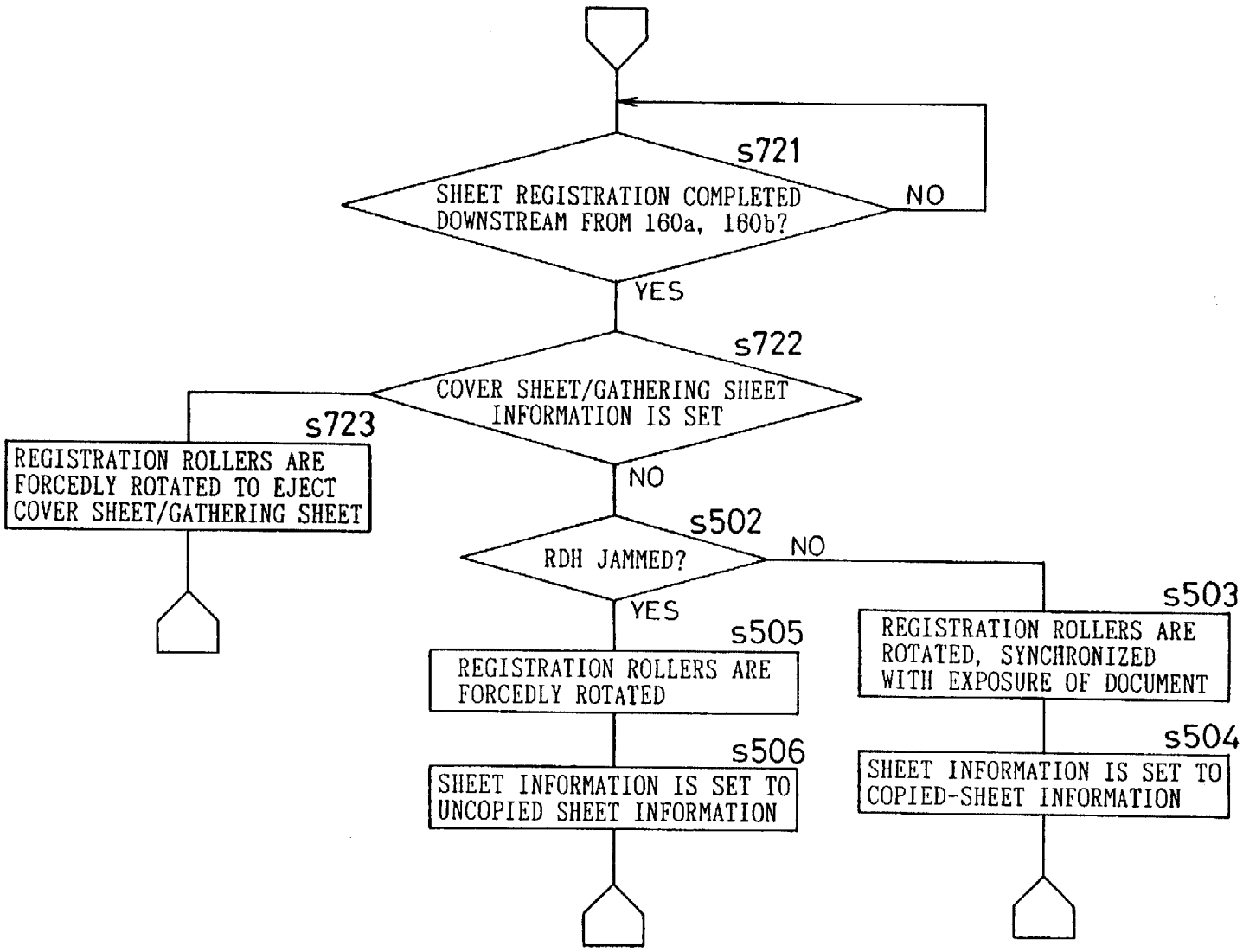
FIG. 13 is a flow chart which follows the flow chart shown in FIG. 12.

FIG. 12 and FIG. 13 are flow charts illustrative of an operating procedure for feeding blank cover sheets or gathering sheets which will be stacked on the copied sheets to accomplish covering or gathering. When the timer T expires which keeps a sheet-feeding cycle time (S701), the CPU examines whether the sheet to be fed next is a blank cover sheet or gathering sheet (S702). When the next fed sheet is a blank cover sheet or gathering sheet, the timer T is set for a sheet-feeding cycle time, and feeding of sheets is initiated (S703). Here, the bit representing blank-cover information in the sheet data of interest in the RAM 181 is set to "1". When the sheet to be fed next is neither a blank cover sheet nor a gathering sheet, normal-sheet information is set in the sheet data of interest in the RAM 181 (S705) after the processes in S402–S408 explained with reference to FIG. 9 have been carried out. Here, the determination in S702 on whether the sheet to be fed is a blank cover sheet or gathering sheet is performed with reference to cover-processing data which has been inputted by the operator to indicate the sheet page number at which the cover sheet or the gathering sheet is inserted. The covering data also includes data indicating the sheet cassette which holds the sheets used as cover sheets or gathering sheets; special-purpose sheets may be fed from a predetermined sheet cassette as cover sheets or gathering sheets.

In addition, when a fed sheet reaches the registration rollers 160*a* and 160*b* (S721), the CPU 179 examines whether cover sheet/gathering sheet information has been set in sheet data for the sheet of interest in the RAM 181 (S722). When the cover sheet/gathering sheet information has been set in the sheet data for the sheet of interest, the sheet is ejected to the ejected-sheet tray 111 by forced rotation of the registration rollers 160*a* and 160*b*, without undergoing a copying process (S723). In cases where no cover sheet/gathering sheet information has been set in any sheet data, the processes in S502–S506 described with reference to FIG. 10 are carried out. The foregoing process allows precise execution of a preset process for cover sheets/gathering sheets.

Figure 14:
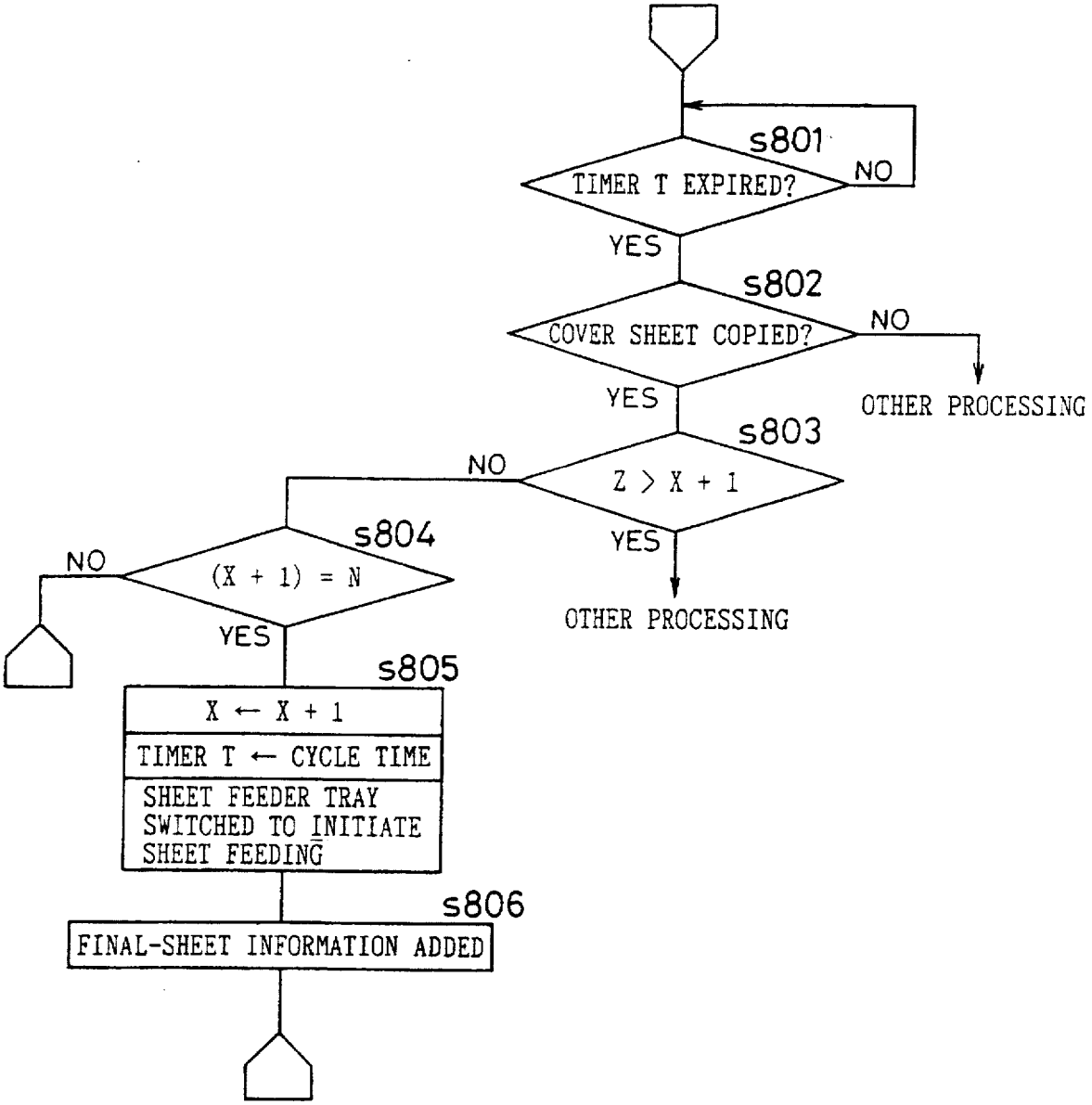
FIG. 14 is a flow chart illustrative of part of an operating procedure of the control section of a copying machine when copying on a cover sheet is involved.

An explanation will now be given regarding control for the process of copying on a cover sheet, that is, the process of copying the last document image on a separate type of sheet. When a cover sheet is to be copied, the cover sheet is previously held in a predetermined sheet feeder cassette, and the cover sheet-holding sheet feeder cassette is specified in the data in advance. In this state, as illustrated in FIG. 14, when the timer T expires which keeps the sheet-feeding cycle time (S801), the CPU 179 determines whether a cover sheet-copying process has been set (S802); in cases where a cover sheet-copying process has been set, the count of the counter Z is compared with the result of addition of "1" to the count of the counter X (S803). When the result of addition of "1" to the number of sheets fed up to that time matches the maximum document page number, the result of addition of "1" to the number of fed sheets is compared with the total document page number N (S804), and when the two are identical, the count of the counter X is incremented, and concurrently the timer T is set for a sheet-feeding cycle time, and the sheet feeder cassette is switched to a predetermined sheet feeder cassette for cover sheets to initiate feeding of the sheets (S805). In addition, final-sheet information is added to the sheet data of interest in the RAM 181 (S806). The foregoing process allows a speedy copying operation without lowering the sheet-feeding speed even when the process involves copying on cover sheets.

Figure 15:
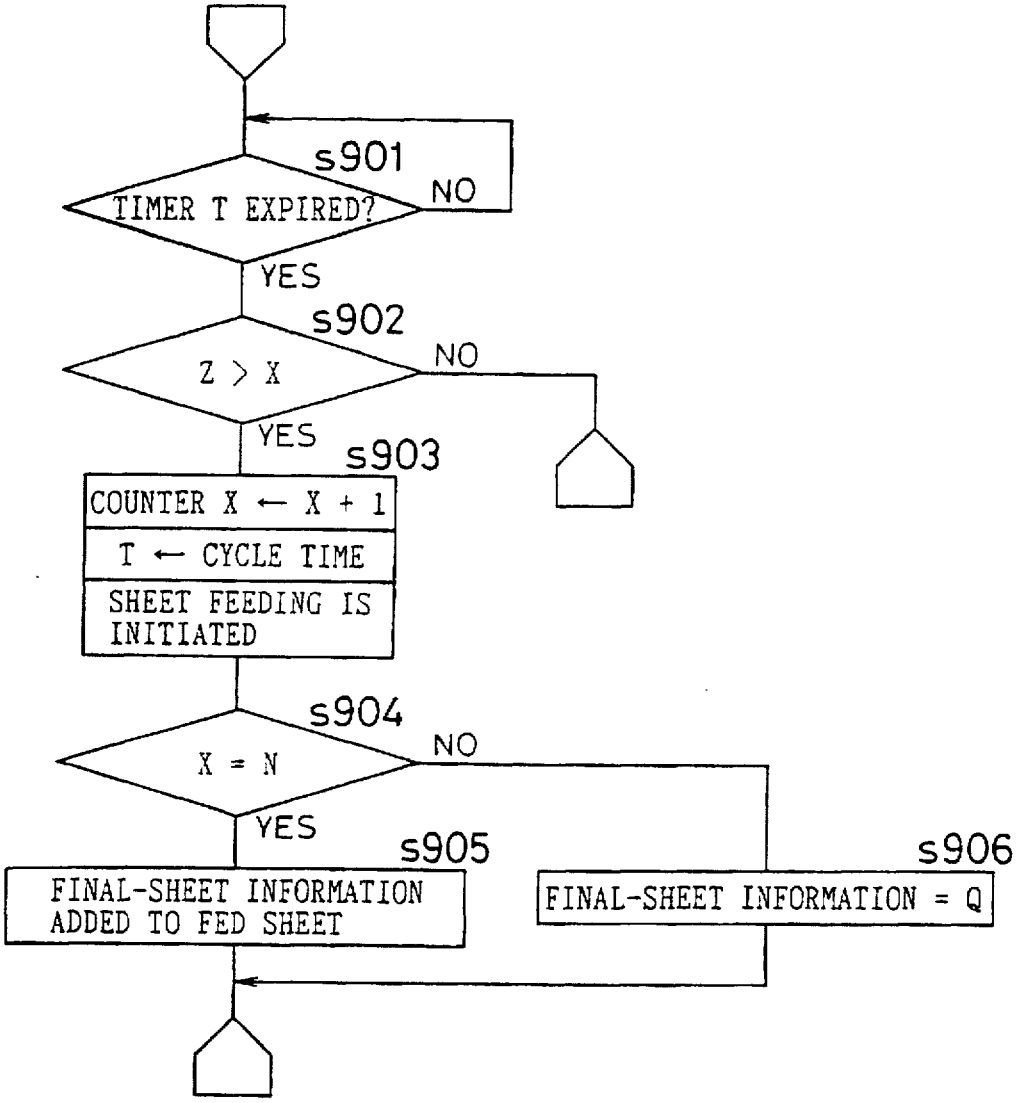
FIG. 15 is a flow chart illustrative of part of an operating procedure of a copying machine according to yet another embodiment of the present invention.

In contrast, when the number of document pages is relatively small, and the total document page number N has already been determined when sheets are fed, the count of the counter X which counts fed sheets is compared with the total document page number N each time a sheet is fed (S901–S904), and final-sheet information is added to the sheet data for the sheet of interest in the RAM 181 only when the number of fed sheets matches the total document page number N (S905, S906), as illustrated in FIG. 15. As described above, since it is possible to determine whether each fed sheet is the final sheet, post-processing of sheets may be carried out precisely.

Figure 16A:
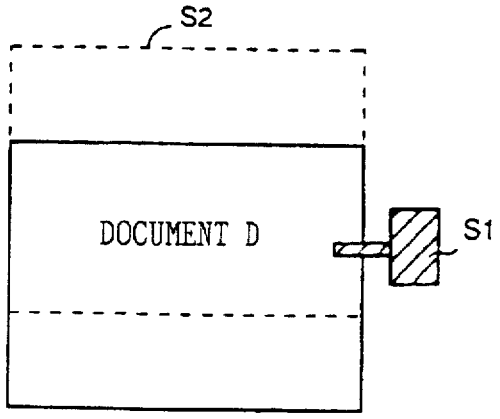
FIGS. 16A and 16B are views illustrative of the mounted positions of sensors in the recirculative document handler shown in FIG. 2.
Figure 16B:
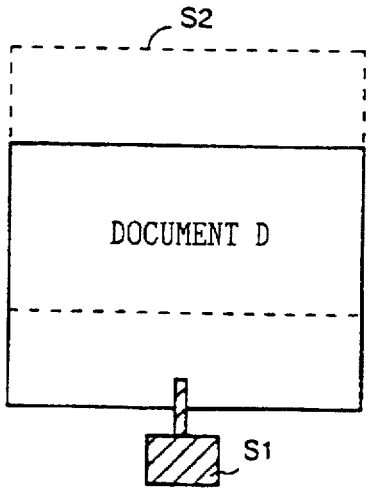

In addition, in cases where the one-circulation detecting sensor S1 is used to determine whether a not-yet-fed document is present each time a document is fed in the RDH 1, the relative installation positions of the sensor S2 which detects completion of feeding of each document and the one-circulation detecting sensor S1 are important. Specifically, as illustrated in FIG. 16(A), in cases where there is such a positional relationship between the two sensors that the one-circulation detecting sensor S1 detects a fed document at the same instant the sensor S2 detects the document, the total document page number cannot be exactly detected even when the fed document is the final document. Therefore, as illustrated in FIG. 16(B), by installing the one-circulation detecting sensor S1 at the position of the document-holding section 2 which faces the rear-ends of the documents, in the direction of conveyance, the presence or absence of a not-yet-fed document in the document-holding section 2 can be speedy and accurately determined.

Although the present embodiment was described with reference to copying machines, the present invention may be equally applied to laser printers and other electrophotographic image-forming apparatuses.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image-forming apparatus equipped with a recirculative document handler for feeding documents, the apparatus comprising:

a document-feed counter which is incremented each time a document is fed; a sheet-feed counter which is incremented each time a sheet is fed; and maximum document-page-number storage means which determines whether all the documents have been fed each time a document has been fed, and stores a result as an addition of "1" to the count of the document-feed counter in cases where all the documents have not yet been fed, wherein feeding of a subsequent sheet is allowed when the count of the sheet-feed counter is smaller than a value stored in the maximum document-page-number storage means.

2. The image-forming apparatus according to claim 1, wherein the value stored in the maximum document-page-number storage means is corrected depending on a set image-forming mode.

3. The image-forming apparatus according to claim 2, wherein the value is corrected to store a new value by following the equation: $Z'=Z/2$ wherein Z' is a new value and Z is the value stored in the maximum document-page-number storage means, when an image-forming mode is set for copying images of single-sided documents on double-sided sheets.

4. The image-forming apparatus according to claim 2, wherein the value is corrected to store a new value by following the equation: $Z'=2Z$ wherein Z' is a new value and Z is the value stored in the maximum document-page-number storage means, when an image-forming mode is set for copying images of double-sided documents on single-sided sheets.

5. The image-forming apparatus according to claim 1, further comprising: sheet-information storage means for storing information about individual sheets to be fed; and total document-page-number storage means which determines whether all the documents have been fed each time a document has been fed, and stores the count of the document-feed counter as a total document page number when all the documents have been fed, wherein when the count of the sheet-feed counter matches a value stored in the total document-page-number storage means, information about a final sheet is added to the sheet-information about preceding fed sheets.

6. The image-forming apparatus according to claim 5, wherein the value stored in the maximum document-page-number storage means is corrected depending on a set image-forming mode.

7. The image-forming apparatus according to claim 6, wherein the value is corrected to store a new value by following the equation: $Z'-Z/2$ wherein Z' is a new value and Z is the value stored in the maximum document-page-number storage means, when an image-forming mode is set for copying images of single-sided documents on double-sided sheets.

8. The image-forming apparatus according to claim 6, wherein the value is corrected to store a new value by following the equation: $Z'-2Z$ wherein Z' is a new value and Z is the value stored in the maximum document-page-number storage means, when an image-forming mode is set for copying images of double-sided documents on single-sided sheets.

* * * * *